United States Patent [19]

Farino

[11] 4,286,601

[45] Sep. 1, 1981

[54] WEIGHT DISTRIBUTING DEVICE FOR USE UNDER AN X-RAY APRON

[76] Inventor: Frank G. Farino, 3311 Warrensville Center Rd., Shaker Heights, Ohio 44122

[21] Appl. No.: 81,764

[22] Filed: Oct. 4, 1979

[51] Int. Cl.[3] ..... A41C 3/00
[52] U.S. Cl. ..... 128/486
[58] Field of Search ..... 128/486; 2/49–52, 2/1, 92; 250/516

[56] References Cited

U.S. PATENT DOCUMENTS

| | | | |
|---|---|---|---|
| 2,518,975 | 8/1950 | Chishoum | 128/486 |
| 3,154,789 | 11/1964 | Lewis, Jr. | 2/92 |

*Primary Examiner*—Doris L. Troutman
*Attorney, Agent, or Firm*—Meyer, Tilberry & Body

[57] ABSTRACT

A weight distributing device to be worn at the bustline and between the outer garment covering the breasts of a woman and a shield x-ray protective apron. This device distributes gravity forces caused by the weight of the apron away from the breasts to prevent trauma, discomfort and injury to the breasts of a woman wearing an X-ray protective apron.

12 Claims, 6 Drawing Figures

WEIGHT DISTRIBUTING DEVICE FOR USE UNDER AN X-RAY APRON

The present invention relates to the art of X-ray aprons of the type used to protect radiology technicians, and more particularly to a weight distributing device to be worn by a female technician to distribute the weight of the protective apron away from the breast area of the technician.

BACKGROUND OF THE INVENTION

Radiologists and X-ray technicians often wear protective X-ray aprons which include a shielding layer of lead. This type of apron shields the radiologist and technician from exposure to X-rays emanating from an X-ray machine. Such an apron is also used in laboratories and industries where X-ray machines are employed for a variety of purposes. These aprons are extremely heavy because of the shield lead and its supporting structure. When the apron is worn by a female technician or employee, especially such an employee with a relatively full bustline, the force of the apron against the breasts can cause irritation to at least the areola area of the breast. This irritation is increased by movement of a person wearing such an apron. Irritation of the breasts is uncomfortable and can cause trauma to the breasts. For that reason, there is a substantial need for some type of structure to prevent injury to the breasts of the female employee wearing an X-ray protective apron for prolonged periods. The manufacturers of X-ray aprons have been seeking some arrangement to prevent the irritation and injury caused by their aprons without making each apron useful for only one person or type of person.

THE INVENTION

The present invention relates to a protective device for use by a female technician or employee who must wear a protective X-ray shielding apron for prolonged times. In accordance with the present invention, there is provided a weight distributing device to be worn at the bustline of such employee or technician. This device is worn between the outer garment covering the breasts of the technician or employee and the shielded X-ray protective apron. The apron has a substantial weight which causes forces to be directed toward the breasts of the person wearing the apron. As a person moves, this constant pressure or force can irritate the breasts with obvious results. In accordance with the invention, the weight distributing device includes first and second protective hollow domes with internal cavities greater in size than the breasts to be protected, with each of the domes being formed by an inner fabric layer, an outer fabric layer and a free standing generally conical cup sandwiched between the layers so that the layers can be combined to form a pocket for the conical cup forming the actual shape of each dome. The invention also includes means for connecting the domes together and means for forming the connected domes into a bustline encircling band having free ends which can be fastened together to support the domes over the outer garment of a person using the protective device. In this manner, a technician or employee can apply the protective device over outer garments without removing clothing. The protective device then forms protective domes over the breasts of the female employees and between the outer garment of the employee and the X-ray shielding apron. In this manner, the protective device may be used by a number of employees or technicians. Also, the apron may be used by both male and female employees or technicians. The protective device is not incorporated into the apron nor is it worn under the outer garments of the technician or employee. Thus, it provides a device which can be used by a number of female employees or technicians and in a manner to protect their breasts from injury and trauma caused by the forces normally exerted against the breasts by the X-ray shielding apron without partial disrobing.

The primary object of the present invention is the provision of a weight distributing device to be worn at the bustline of an x-ray technician or employee, which device distributes the weight of a X-ray protective apron in a manner to relieve pressure and forces from the breasts of the employee or technician.

A further object of the present invention is the provision of a weight distributing device to be used over the outer garment of a female employee which device can be used by several female employees and has a pair of protective breast receiving domes which have a large size to protect breasts of various proportions.

Still a further object of the present invention is the provision of a weight distributing device to be used between the outer garments of a female technician or employee and a protective X-ray apron, which device does not form a part of the under garment of the employee or technician, does not require modification of the apron itself, and can be used by several persons.

Still a further object of the present invention is the provision of a weight distributing device as defined above, which device can be used by several females without partial disrobing and substantially reduces the overall cost of using the device in a laboratory, hospital, clinic or industrial environment.

These and other objects and advantages will become apparent from the following description.

PREFERRED EMBODIMENT

Figure 1:
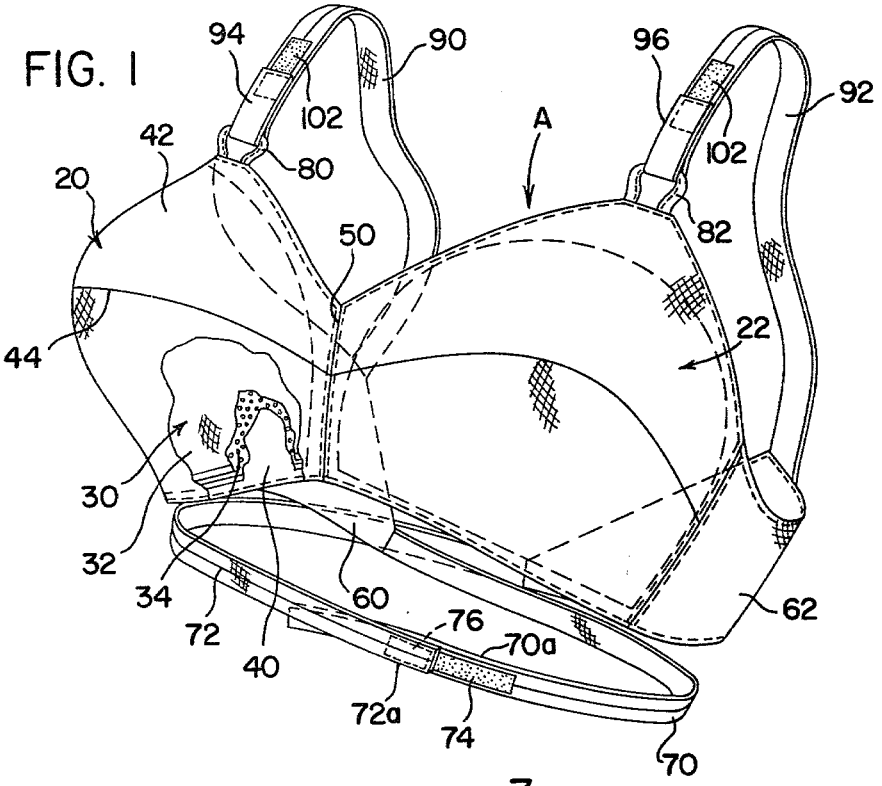
FIG. 1 is a pictorial view showing a weight distributing device constructed in accordance with the present invention.
Figure 4:
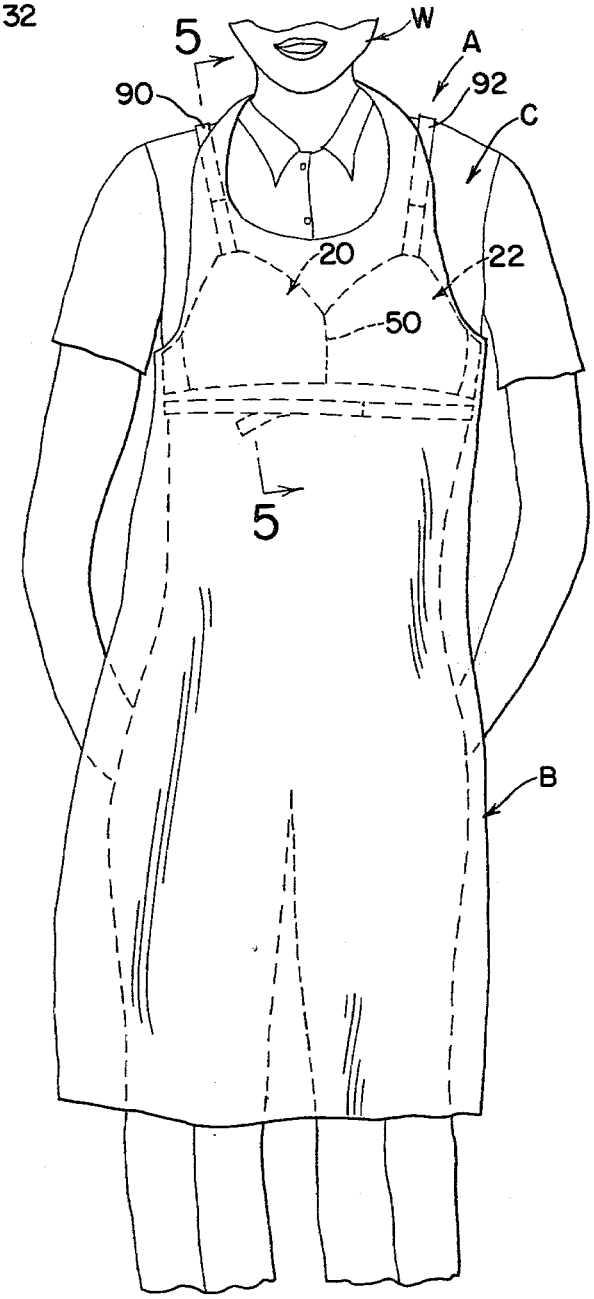
FIG. 4 is a front view of a female employee or technician wearing an X-ray shielded apron and a weight distributing device constructed in accordance with the present invention.
Figure 6:
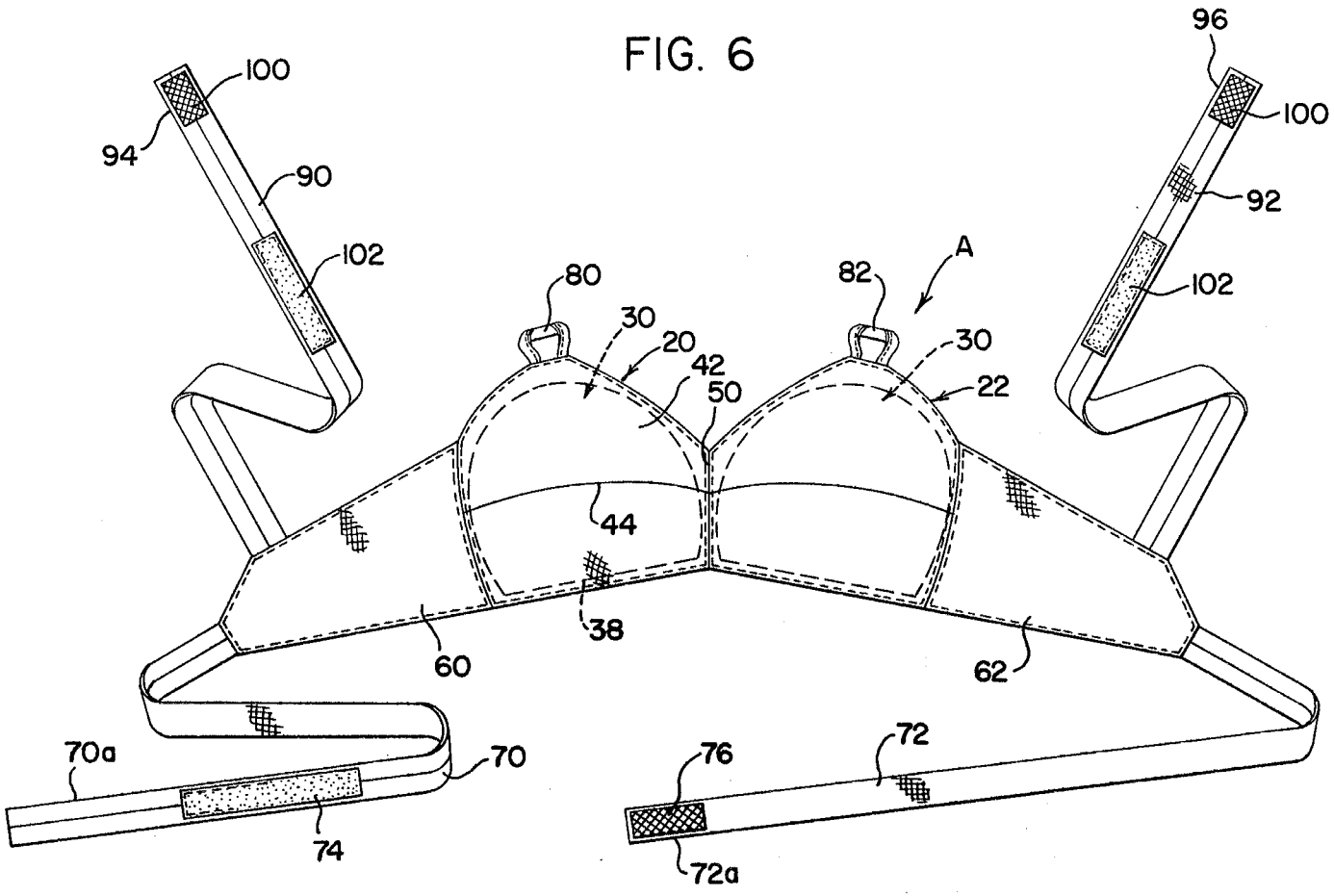

Referring now to the drawings wherein the showings are for the purpose of illustrating a preferred embodiment of the invention only and not for the purpose of limiting same, FIGS. 1, 4 and 6 taken together show a weight distributing device A for use between an outer, shielded X-ray apron B and the outer garments C worn by a female employee or technician W who uses the apron for shielding herself from exposure to X-ray radiation. In accordance with the illustration, the outer garment C is a blouse, sweater, dress or other such garment under which the technician or employee wears a standard brassiere 10 having a standard bustline encircling band 12 and shoulder straps 14. Thus, the employee or technician W using weight distributing device A wears standard clothing including an outer garment C and an under garment or brassiere 10. Over this outer garment the protective device A is worn. This device has the general appearance of a brassiere, except the central breast covering portions are semi-rigid and do not conform to the bust contour. This device is interposed between the outer garment and its protrusion caused by the breasts of the employee or technician and the weighted apron B which weighs several pounds and can put a substantial strain on the breasts of a female employee or technician during the constant use.

Figure 2:
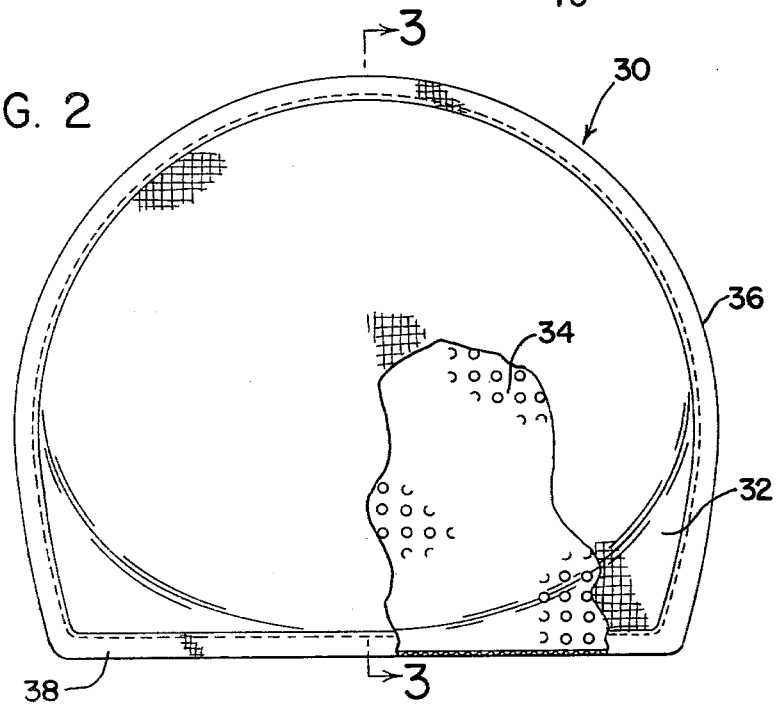
FIG. 2 is an enlarged, partially cut away view showing the semi-rigid cup structure used in the preferred embodiment of the present invention.
Figure 3:
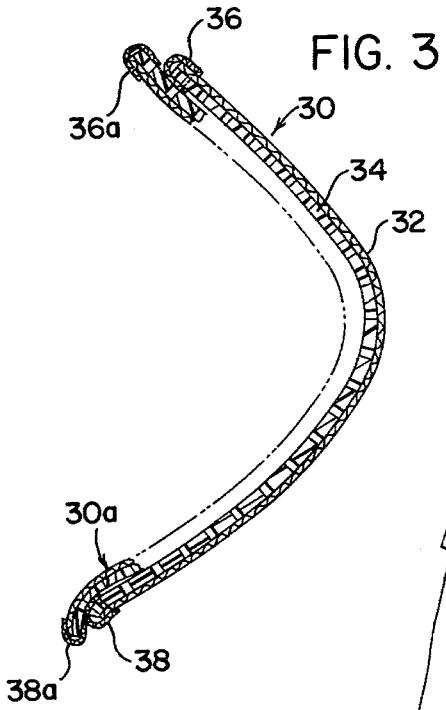
FIG. 3 is a cross-sectional view taken generally along the line 3—3 of FIG. 2.
Figure 5:
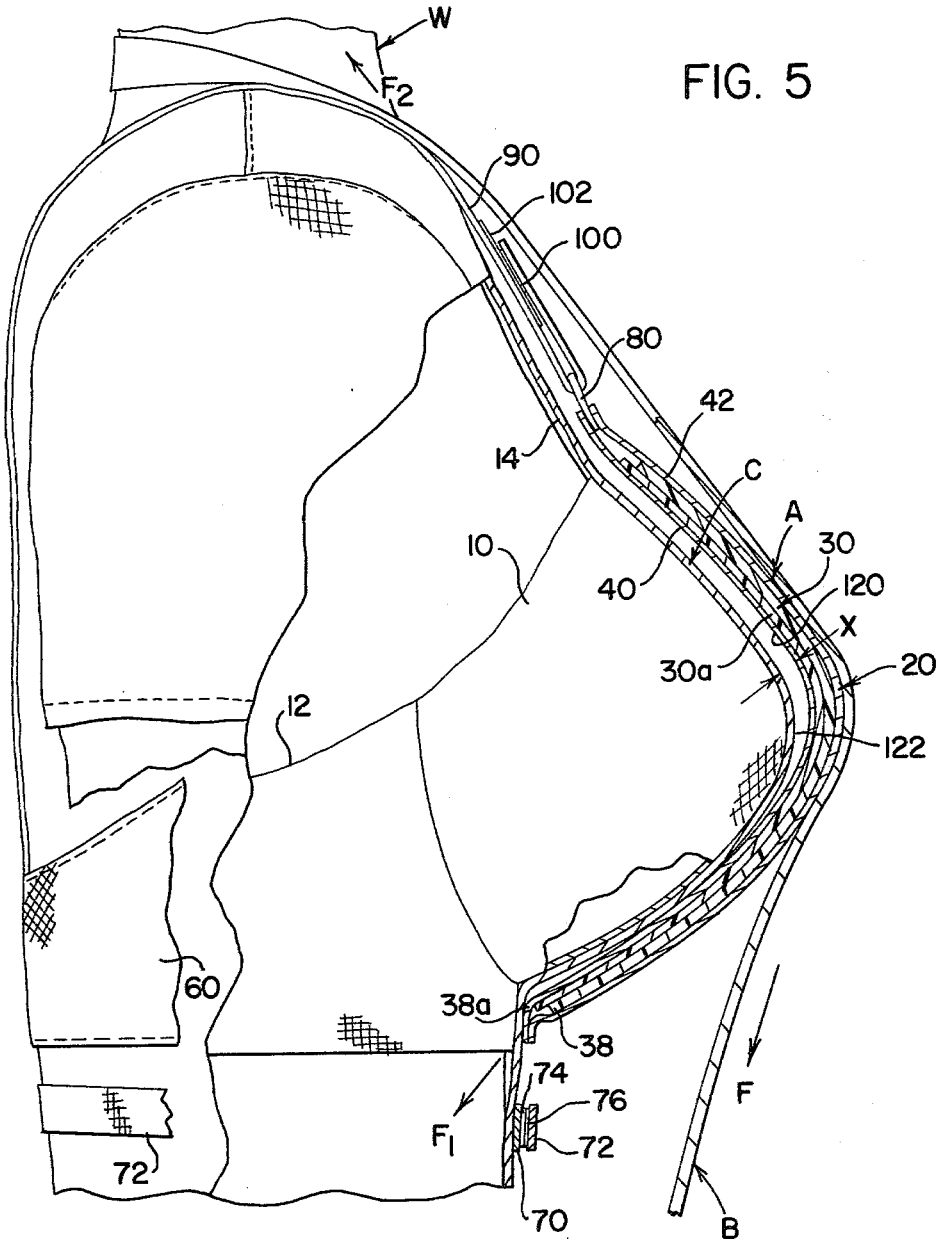
FIG. 5 is an enlarged partially cross-sectioned and partially cut-away view taken generally along the line 5—5 of FIG. 4; and, FIG. 6 is a plan view showing the embodiment of the invention in the disassembled form.

The weight distributing device A, as shown in FIG. 5, is used to transmit the force F, caused by the weight of apron B, from the breasts of technician or employee W to a large area body portion of the technician or employee located below the bustline. This weight shifting or distribution is illustrated by the arrow $F_1$ wherein the force F is exerted below the bustline and is absorbed by employee W below the bustline by use of the protective device or weight distributing device A. This device includes two spaced domes 20, 22 each of which are substantially the same in construction. Consequently, dome 20 will be described in detail. This description will apply equally to dome 22. Each of these domes formed a semi-rigid, slightly deflectable, protective shield around the breast area of employee or technician W. Only a single size dome is employed for females having a large range of breast sizes. In this manner, device A can be used by several employees. A cup size "D" could be used for the domes. Females having various sized breasts would use this same device. Thus, the weight distributing device A is a separate implement to be used by one of several employees or technicians at a position between the outer garment of the employee or technician and the heavy X-ray shielding apron B. In accordance with the preferred embodiment, dome 20 includes a semi-rigid cup 30 formed from a fabric 32 adhered to the outer surface of a semi-rigid plastic, perforated conical form 34 molded from a plastic material such as polyethelene having a thickness in the general range of 0.03–0.06 inches. This conical form is molded to have a desired shape to fit over the breast of the employee or technician W. Around the edge of conical form 34, fabric 32 is folded into a seam and stitched to produce a generally arcuate marginal seam 36 and a generally straight lower marginal seam 38, as best shown in FIG. 2. This construction of a breast cup formed from molded plastic with a outer fabric layer and a marginal seam is known in the bathing suit art. Such a molded cup is employed only for bathing suits and then in a manner intended to generally match the breasts of the wearer. In the present invention, this standard available molded cup structure is not used to match the breast of the wearer. Indeed, it is intended to be substantially larger than the breast to be protected. Thus, a relatively large semi-rigid cup 30 is employed in both spaced domes 20,22. In addition, in the preferred embodiment of the invention, two semi-rigid breast cups 30 are employed in each dome. This is best shown in FIGS. 3 and 5 wherein a second breast cup 30*a* is combined with the breast cup 30 and has substantially the same construction. These two breast cups double the rigidity in the axial direction of the generally conical by shaped domes 20,22. In practice, two or more standard breast forms can be used to form a single dome, which dome constitutes the protective receptacles to be placed over each breast of the employee or technician W. To hold the breast cups 30, 30*a* in place, there is provided an inner fabric layer 40 and an outer fabric layer 42. In accordance with standard practice, to form the desired contour for the inner and outer layers 40, 42, there is provided a transversely extended contour seam 44 in the layer 42. Of course, a similar seam is provided in the inner layer 40.

As best shown in FIGS. 1 and 6, the two spaced domes 20,22 are secured together by a seam 50 and have outer edges terminating in side panels 60,62. These side panels, in turn, are stitched to relatively long back straps 70,72 each having free ends 70*a*, 72*a*, respectively. The back straps include a VELCRO fastener or other fastening arrangement. In the VELCRO concept, female patch 74 on backstrap 70 is used in conjunction with male patch 76 on the strap 72. This structure is shown in FIG. 6 and the use thereof is best shown in FIG. 1. As can be seen, the backstraps wrap around the body of the person wearing protective device A and is connected in the front as shown in FIGS. 1 and 4. Above each dome there is provided a loop 80,82 respectively. These loops coact with shoulder straps 90,92 having free ends 94,96. A set of VELCRO patches 100,102 is provided at the free ends 94,96 to support the weight distributing device A in a vertical direction as shown in FIG. 1. With these straps, some of the weight represented as F in FIG. 5, is distributed through the shoulder straps to user W. This reduces force $F_1$. The VELCRO patches provide infinite variations in the connecting position within a wide range of adjustments. Thus, this type of coupling is helpful since protective or weight distributing device A is intended for use by various female employees or technicians. Of course, the back strap and shoulder straps could be tied or otherwise secured together in the configurations shown in FIGS. 1 and 4 without departing from the intended spirit and scope of the present invention.

As illustrated in FIG. 5, the preferred embodiment of the present invention provides a dome, either 20 or 22, which has an inner concave surface 120 that is larger than the outer convex surface 122 formed by the breast and outer garment C of technician or employee W. Thus, under normal circumstances there is a space X between surfaces 120,122, at the least the upper portion of the breast defining convex surface 122. This transmits the force through the semi-rigid cups 30,30*a* to the lower seam area 38,38*a* of the respective cups. With straps 90,92, the magnitude of force $F_1$ is reduced in an amount represented generally as force $F_2$. The interaction of these two forces still prevents absorption of pressure by the breasts under domes 20,22. Consequently, the force F exerted by gravity pull of apron B is exerted through the semi-rigid cups 30,30*a* to a portion of the body below the bust or bustline of the person W wearing the protective and weight distributing device A and to the upper shoulder area of person W. Domes 20,22 prevent irritation to the breasts. Constant forces exerted on the breasts are eliminated. Device A can be used by several employees. It is not a part of the apron; therefore, a single apron can be used by male and female technicians and employees. Also, female employees having relatively small bustlines or breasts may not need to wear the protective device. Consequently, the protective device which is selectively useable between the outer garment of an employee or technician and the weighted X-ray shield provides extreme versatility. As another advantage, the protective device A is employed over the outer garments of the employee or technician so that there is no need to disrobe to position the device. Also, since the device is larger than the breast, its use over the outer garments instead of under the outer garments substantially reduces wear and stretching which could be imposed by this type of device under certain outer garments. All of these advantages are obtained from the use of a preferred embodiment of the present invention.

Having thus described the invention, it is claimed:

1. A weight distributing device to be worn at the bustline and between the outer garment covering the breasts of a woman and a shielded x-ray protective apron having a given weight to distribute gravity forces caused by said weight of said apron away from said breasts, said weight distributing device comprising: a body encircling band terminating in two spaced straps with free ends, means for connecting said free ends to hold said band about the bustline of said woman, first and second generally rigid, protective domes spaced longitudinally of said band, each of said domes adapted to overlie said outer garment at one of said breasts in a manner to recieve said breast in said dome, each of said protective domes including an outer layer of sheet material, an inner layer of sheet material and a free standing generally conical cup sandwiched between said layers, said domes forming a part of said band and being held by said band over the breasts of a user of said device and said conical cups of said protective domes being generally rigid in a direction axially toward said breasts whereby a force from said apron against said domes will be transmitted away from said breasts under said domes.

2. A weight distributing device as defined in claim 1 including a fabric loop at the top of each dome and a separate back strap extending from said band to each of said loops when said device is being worn.

3. A weight distributing device as defined in claim 2 including female and male VELCRO fastening strips spaced along each of said back straps and adapted to form a releaseable loop extending through one of said dome loops.

4. A weight distributing device as defined in claim 3 wherein said band has a length between said free ends which generally exceeds twice the intended encircling length of said band whereby said connecting means is located in the front of a woman-wearing said device.

5. A weight distributing device as defined in claim 4 wherein said connecting means includes a female VELCRO element on one of said free ends and a male VELCRO element on the other of said free ends.

6. A weight distributing device as defined in claim 1 wherein said band has a length between said free ends which generally exceeds twice the intended encircling length of said band whereby said connecting means is located in the front of a woman wearing said device.

7. A weight distributing device as defined in claim 2 wherein said band has a length between said free ends which generally exceeds twice the intended encircling length of said band whereby said connecting means is located in the front of a woman wearing said device.

8. A weight distributing device as defined in claim 1 wherein said conical cup is formed from a plurality of stacked conical cup elements.

9. A weight distributing device as defined in claim 8 wherein said cup elements each are formed from a layer of fabric over a semi-rigid form of perforated sheet plastic material.

10. A weight distributing device as defined in claim 1 wherein said conical cup includes at least one cup element formed from a layer of fabric over a semi-rigid form of plastic sheet material.

11. A weight distributing device to be worn at the bustline and between the outer garment covering the breasts of a woman and a shielded x-ray protective apron having a given weight to distribute gravity forces caused by said weight of said apron away from said breasts, said weight distributing device comprising: first and second protective hollow domes with internal cavities greater in size than the breasts to be protected, each of said domes being formed by an inner fabric layer, an outer fabric layer and a free standing generally conical cup sandwiched between said layers, said layers combining to form a pocket for said conical cup of each dome, means for connecting said domes together, means for forming said connected domes into a bustline encircling band with free ends and means for fastening said free ends together with said band encircling said bustline and said domes over the breasts of a user of an X-ray apron.

12. A weight distributing device as defined in claim 11 wherein said outer garment at each breast has an outwardly facing surface with a convex surface and each of said domes has an inwardly facing surface with a concave surface generally larger than said convex surface, and said dome having a lower edge for transmitting forces applied to said domes to body areas below said domes.

* * * * *